United States Patent [19]

Howard

[11] 4,158,188

[45] Jun. 12, 1979

[54] FUSE WITH FREE STANDING HELICAL FUSE ELEMENT AND METHOD OF MAKING THE SAME

[75] Inventor: John F. Howard, Peterborough, Canada

[73] Assignee: Canadian General Electric Company Limited, Canada

[21] Appl. No.: 918,201

[22] Filed: Jun. 22, 1978

[30] Foreign Application Priority Data

Aug. 19, 1977 [CA] Canada ..... 285128

[51] Int. Cl.[2] ..... H01H 85/04

[52] U.S. Cl. ..... 337/290; 337/295; 29/623

[58] Field of Search ..... 337/158, 159, 186, 187, 337/290, 295; 29/623

[56] References Cited

U.S. PATENT DOCUMENTS

| | | | |
|---|---|---|---|
| 3,287,524 | 11/1966 | Huber et al. | 337/290 X |
| 3,740,687 | 6/1973 | Cameron | 337/295 X |
| 4,028,655 | 6/1977 | Koch | 337/295 X |

FOREIGN PATENT DOCUMENTS

| | | | |
|---|---|---|---|
| 813643 | 5/1959 | United Kingdom | 337/295 |
| 1089675 | 11/1967 | United Kingdom | 337/295 |

*Primary Examiner*—George Harris

*Attorney, Agent, or Firm*—William Freedman; Carl L. Silverman

[57] ABSTRACT

A high voltage combination fuse has a current limiting section which has a free standing, helical coil of fusible wire material. The support for the free standing coil comes only from the pulverulent arc quenching material which fills the fuse casing and surrounds the coil. The coil has a foot portion and a head portion of increased cross-section to avoid arcing in the immediate vicinity of the end caps. The foot and head portions are preferably formed by doubling back a length of wire at the respective end and wrapping the tip of the doubled back length around the wire.

11 Claims, 3 Drawing Figures

FUSE WITH FREE STANDING HELICAL FUSE ELEMENT AND METHOD OF MAKING THE SAME

BACKGROUND OF THE INVENTION

This invention relates to a fuse with a free standing fuse element, and in particular it relates to the high voltage, current limiting section of a combination fuse which section has a free standing fuse element.

A combination fuse has two principle parts or sections, namely a current limiting section or cartridge section and a low current section or expulsion section. The current limiting section comprises a cylindrical cartridge which totally encloses a conductor several times as long as the cartridge. The low current or expulsion section comprises an expulsion device mounted on one end of the cartridge and including a fusible link designed to open the circuit under severe fault conditions and provide a visible indication of the open circuit. The conductor in the cartridge and the link in the expulsion device are connected in series electrically.

The expulsion device frequently has an open ended expulsion tube which contains the link and a flexible cable secured to the fuse link and extending out the open end of the tube. The flexible cable is fastened to a spring arrangement which places a force on the cable keeping the cable and link under tension. When the link fuses it creates an arc which generates gases. The gases and the spring force cause the cable to be expelled from the tube and the expelled cable shows there is an air gap in the circuit and is a visible indication of a blown fuse.

In a combination fuse, the current limiting section functions to reduce or limit the magnitude of a large fault current so that the somewhat slower fusible link in the expulsion device is able to handle the reduced current and provide a visible air gap.

The fuse of this invention is intended primarily for use in a capacitor installation of a power system where failure of a capacitor could involve a considerable amount of electrical energy. At the present time voltages to be handled may be as high as 15 to 20 KV and in the future this is likely to increase. There are two types of sources of energy when such a capacitor fails. There is a transient high frequency oscillation of short duration and a power frequency current which flows from the power system and which may be more than 4000 to 6000 amperes if the capacitor banks are not in series. When large amounts of energy are involved in a capacitor installation, it is normal to protect each capacitor with a combination fuse, and because of a need for great current limiting capacity, it is not uncommon to require in the current limiting section a conductor or fuse element which is many times the length of the cartridge. For example, a conductor having a length greater than four feet is frequently used and a length of six to eight feet is not unusual. This length provides for many arcs and there is contact on all sides with the surrounding arc quenching material. The fuse element is normally in a helical configuration within a tubular fuse casing of insulating material. The helical configuration enables the long length of fuse element to be contained in a reasonable length of a cartridge or fuse casing.

The helically formed fuse element or conductor in the current limiting section of a combination fuse is frequently wound on a mandrel of ceramic or other insulating and supporting material which supports it in the casing. It has been recognized that it would be desirable to eliminate the mandrel as it interferes at least to some extent with the contact between the fuse element and the arc quenching material and consequently with the quenching or extinguishing of arcs. In other words, it has been recognized that it would be desirable to have a "free standing" or self supporting fuse element where the term "free standing" fuse element is intended to mean a fuse element mounted within a casing without the use of a mandrel or post to support it. It will, of course, be apparent that when the fuse is complete, the pulverulent arc quenching material with which the fuse casing is filled will provide a degree of support to the fuse element in the sense that it will prevent or greatly reduce movement of the fuse element.

In the past, there have been high voltage fuses which had free standing fuse elements. These fuses were high voltage fuses but were generally intended for use with motors or other equipment. They frequently had a plurality of smaller fuse elements in parallel within a fuse casing. It is believed the prior art fuses of this type were not intended for use with capacitor installations and would not normally have single fuse elements exceeding, for example, four or five feet in length.

One such fuse is disclosed in British Specification No. 807,347 in the name of The General Electric Co. Ltd. and published Jan. 14, 1959. It describes a high voltage fuse having a ribbon-like, free standing, fuse element. The fuse element had a complex cross-section intended to impart rigidity to the element, and it did not require a mandrel. It was not a flat ribbon and the manufacture of the element was more difficult. The fuse element used a greater amount of material without a corresponding increase in the surface and thus without a corresponding increase in contact with the arc quenching material.

As another example, U.S. Pat. No. 3,571,755 to Kozacka et al, issued Mar. 23, 1971, describes a current limiting, high voltage fuse having a plurality of free standing ribbon fuse elements of silver and in helical form. The diameters of the helices are relatively small (of the order of three-sixteenths to one-half inch in diameter). The plurality of fuse elements are evenly distributed around the axis of the tubular casing and extend from one end cap to the other. The smaller diameter limits the length of element that a given casing may contain.

As yet another example, U.S. Pat. No. 4,001,748 to Salzer issued Jan. 4, 1977 describes a high voltage fuse with a free standing element where the fuse element is temporarily supported during manufacture by several rods. The rods are withdrawn once the arc quenching material fills the casing.

The prior art fuse structures, having free standing elements, of which applicant is aware, have fuse elements of shorter lengths, and are believed to be designed for less arc quenching capability than is necessary for a capacitor installation. Also the manufacture of the prior art fuses is more complex. The making of a current limiting section of a combination fuse with a free standing fuse element of greater length may be more difficult and applicant's invention is concerned with the simple manufacture of this type of fuse.

The present invention is primarily concerned with the coiled conductor, i.e., the coiled fuse element, within the fuse casing or cartridge of the current limiting section. It is supported only at each end during assembly of the current limiting section and maintains a spaced relationship to the fuse casing and between turns. The arc quenching material within the casing completely and intimately surrounds the coiled fuse element thereby improving the transient fault current energy which can be controlled by the current limiting section of the fuse.

Accordingly, it is an object of this invention to provide a current limiting fuse section of a combination fuse having a helical, free standing fuse element of a length exceeding four feet and which is relatively simple to manufacture.

In current limiting sections of combination fuses used in capacitor installations, because of the large initial current surge, it is sometimes found that an arc will form on the fuse element adjacent an end cap and may include or transfer to the end cap causing a hole in the end cap due to localized melting. Such a hole is very undesirable as it provides an opening for escape of high pressures which are formed within the tube. The rapid discharge of material through such an opening is not only dangerous but reduces the current limiting capacity of the fuse.

It is another object of this invention to provide a foot portion and a head portion to the helical fuse element in the region where the elements are connected to the respective end caps, which is of an improved and simple configuration and reduces the tendency for arcing in the fuse adjacent the end caps.

SUMMARY OF THE INVENTION

According to one form of the invention, there is provided a method of making a high voltage, current limiting fuse section comprising the steps of forming a helical coil of a resilient fuse element with a foot portion and a head portion at either end thereof with the head portion extending from the helical coil in a direction substantially parallel to the axis of the helical coil, mounting the foot portion to the inner side of a first end cap; securing the first end cap to one end of a cooperating, hollow, cylindrical, insulating casing with the coil being within the casing and spaced from the walls of the casing; engaging the head portion and withdrawing the head portion until it extends partly past the open end of the casing; filling the casing with pulverulent arc quenching material; securing a second end cap to the open end of the casing with part of the head portion projecting through a small opening in the second end cap; bending the projecting part of the head portion against the outer side of the second end cap and securing it thereto; and sealing the opening in the second end cap.

According to another aspect of the invention, there is provided a high voltage, current limiting fuse section comprising: a tubular casing of insulating material; a first metallic end cap fastened to a first end of the casing closing the first end, a second metallic end cap fastened to a second end of the casing closing the second end; a free standing helical coil of a resilient fusible wire within the casing; and a pulverulent arc quenching material inside the casing filling the casing and contacting the coil, the coil having a foot portion at one end thereof and a head portion at the other end thereof; the foot portion being conductively connected with said first end cap; the head portion extending from the helix in a direction substantially parallel to the axis of said helical coil through an opening in the second end cap filled with a material sealing the opening and is conductively connected with the second end cap on the outer side thereof.

DETAILED DESCRIPTION OF THE INVENTION

Figure 1:
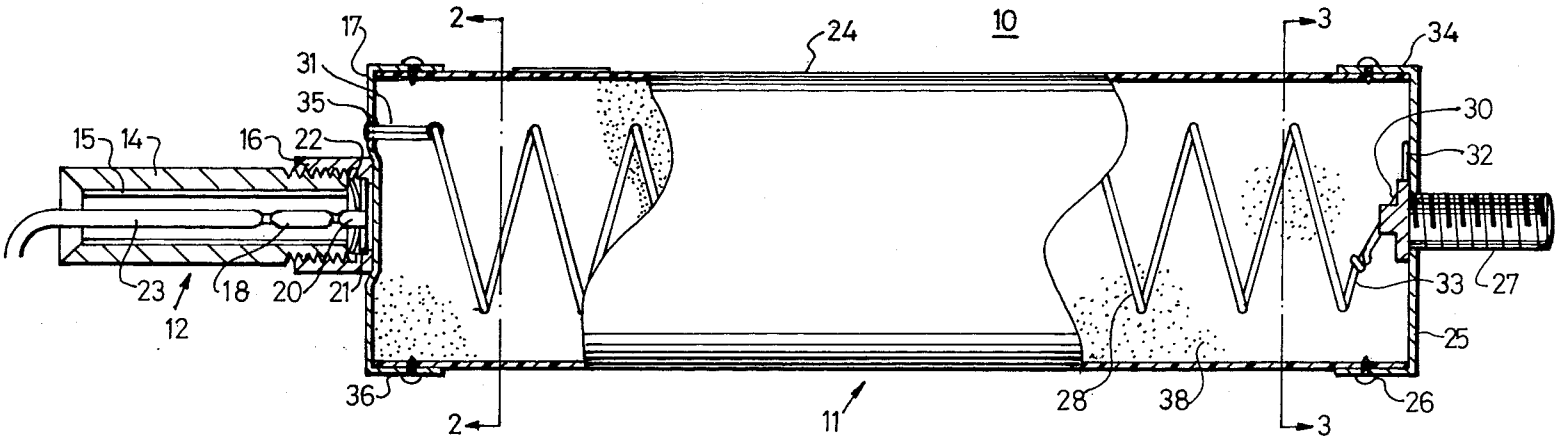
FIG. 1 is a side elevation, partly in section, of a combination fuse according to the invention.
Figure 3:
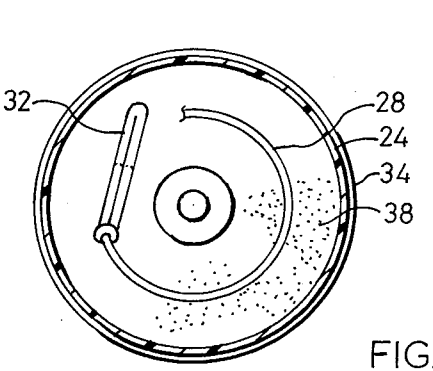
FIGS. 2 and 3 are views taken along lines 2—2 and 3—3 respectively of FIG. 1.
Figure 2:
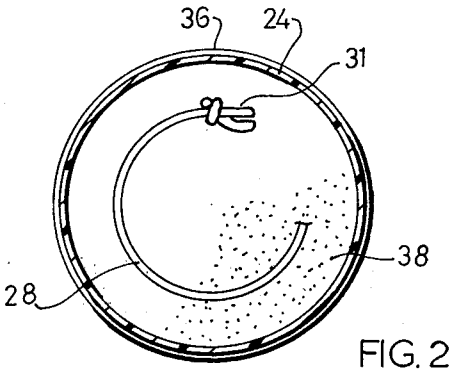

Referring to the drawings, a combination fuse 10 is shown with a current limiting section 11 and an expulsion section 12. The expulsion section 12 is of a type well known in the art and comprises an expulsion tube 14 which preferably has a coating 15 on its inner surface to help in cooling and extinguishing the arc formed when the fuse link blows. The expulsion tube 14 is threaded at one end and is screwed into an end mount 16 which is secured to metal end cap 17. A fuse link 18 is connected to a coupling unit 20 having a disc like end portion 21. A washer 22 is held in place by the end of expulsion tube 14 and engages the end portion 21 so that there is good electrical contact with end cap 17. The other end of the fuse link 18 is connected to a flexible cable 23 which extends within tube 14 and through the open end thereof. Cable 23 is connected to a spring arrangement (not shown) which keeps it under tension. The structure and operation of expulsion tube sections is well known in the art.

The current limiting section 11 has a hollow cylindrical or tubular casing 24 of insulating material, such as, fiberglass and epoxy resin, and has the end cap 17 mounted to and closing one end and has a metal end cap 25 mounted to and closing the other end. The end caps 17 and 25 may be fastened to casing 24 using several self tapping screws 26. Alternately, it is possible to use rivets instead of self tapping screws. A sealing substance is used when mounting the end caps 17 and 25 to the casing 24 to make the section waterproof. A threaded mounting stud 27 is fastened to end cap 25 and projects therefrom for mounting the fuse to a bracket or bus bar (not shown).

Within the casing 24 and spaced from the walls of the casing is a helical coil 28 made of a resilient wire conductor suitable for a fuse element. The coil 28 is connected to end cap 17 at one end and end cap 25 at the other as will be described in more detail. For one example of a helical coil in a fuse intended for operation at 18 KV and to handle currents of the order of 6000 amperes, the coil 28 was made of about 6 feet of 15 AWG tinned copper wire. As the coil 28 is to be self-supporting or free standing it must be of fairly rigid and resilient material. Fuse material in the form of a flat, plain ribbon will normally not meet these requirements.

In order to facilitate mounting and avoid arcing adjacent the end caps, the coil 28 has a foot portion 30 and a head portion 31 which are of increased cross-section, that is, of increased cross-sectional area. The portions of increased cross-section may be formed so they are integral with the coil itself, that is the wire may be formed thicker at the ends, or portions of material may be added as by welding or soldering, or the ends may simply be doubled back to form a length of double thickness and the tip of the doubled length wrapped or wound around the wire to secure it.

A preferred form of making a fuse according to the invention will now be described. A helical coil 28 is formed by winding a desired length of wire on a mandrel. For a current limiting fuse section for use in a capacitor bank for power factor compensation of an electrical system, the high currents to be handled normally require a length of wire for the fuse element to be greater than four feet and usually six to eight feet. This is several times the length of the fuse casing or cartridge. With continued tendency to increase ratings, even longer lengths may be desirable. The mandrel diameter is selected to provide a coil that will fit inside the casing and be spaced from the casing walls. It may be desirable to feed the wire onto the mandrel in a manner which will provide some work-hardening in order to improve the resiliency of the completed coil. The choice of a suitable wire and coil diameter for given characteristics should be well within the capability of those skilled in the art.

When the coil is formed, it must be provided with a foot portion and a head portion. The foot portion 30 is formed by doubling back a short length at one end of the coiled wire, for example about 1½ inches, and placing it in a tool which forms or wraps the free tip of the doubled back length around the wire for at least one turn and preferably one and a quarter to one and a half turns. This secures the doubled back length. This can, of course, be done with a pair of pliers by hand rather than using a tool. The foot portion is then completed by forming the end into a base part 32 and an interim part 33. The base part is parallel to a plane substantially at right angles to the axis of the coil and the interim part is at an angle to the base part extending towards the helix and then curves to become the helix.

The head portion 31 is formed by doubling back a short length at the other end of the coiled wire, again, for example about 1½ inches, and placing it in a tool which wraps the free tip of the doubled back length around the wire for at least a turn. This is exactly the same as for forming the foot portion of increased thickness and may also be done by hand. The head portion 31 is arranged to project from the coil in a direction substantially parallel to the axis of the coil.

The base part 32 of the foot portion of the coil is soldered, brazed or otherwise conductively bonded to the inside of end cap 25. The interim part 33 extends away from the end cap 25 so that part of the coil 28 which is not of increased thickness is spaced from end cap 25 and arcing is avoided in the region adjacent the end cap. The foot portion 30 also provides a firmer mounting for the coil.

Casing 24 has a sealant applied around one end which is then inserted in the rim 34 of end cap 25. The rim 34 of end cap 25 and casing 24 are, of course, made so that there is a close fit. Self-tapping screws 26 are then screwed through rim 34 into casing 24 to secure the end cap 25 to casing 24.

The casing 24 is then placed in an upright position, open end upwards. The coil 28, which it will be recalled is of resilient wire material, extends only part way up the inside of casing 24. The head portion is gripped by pliers or some similar tool and is drawn upwards until it projects part way beyond the open end of casing 24 (it may, for example, project one-half inch). The head portion is adjusted laterally so that the extended coil 28 is centered within casing 24. A spout (not shown) is placed above the open end of casing 24 to discharge pulverulent arc quenching material 38 (for example, quartz sand or silica with additives if desired) into casing 24. Preferably, the arc quenching material 38 is discharged centrally within the coil 28 so that any force it exerts on coil 38, as it drops under the influence of gravity, will be more or less equal in all directions from the axis of the coil and will not tend to displace the coil laterally. The casing 24 may be subjected to a vibration to settle and consolidate the pulverulent material as is known. Sufficient arc quenching material 38 is introduced to ensure there will be no unoccupied space when end cap 17 is applied.

End cap 17 has a small opening or hole 35 through it of a size large enough to receive head portion 31 of coil 28 and located radially the same distance from the axis of end cap 17 as the head portion 31 is from the axis of coil 28. A sealant is applied around the end of casing 24, the end cap 17 is oriented so that hole 35 is aligned with head portion 31 and the rim 36 of end cap 17 is placed over the end of casing 24. The rim 36 is made to be a close fit with casing 24. Self-tapping screws 26 are then screwed through rim 36 into casing 24 to secure end cap 17 to casing 24.

The part of head portion 31 which is projecting through hole 35 in end cap 17 is then bent flat against the outside of end cap 17 and soldered, brazed or otherwise conductively bonded to end cap 17. The soldering or brazing material is conveniently used to seal opening 35. It is sometimes desirable to form a dished part in end cap 17 adjacent opening 35 to receive the projecting end of head portion 31 when it is bent against the end cap. This will leave the outer surface of end cap 17 more or less flush in the region of opening 35.

To complete the assembly of a combination fuse, the washer 22 and disc like end portion 21 are positioned within end mount 16 of end cap 17 with the fuse link 18 and cable 23 extending into expulsion tube 14. Tube 14 is then screwed into the internally threaded end mount 16. The coil 28 is thus in electrical series arrangement with fuse link 18 and cable 23.

As was previously mentioned, the current limiting fuse section according to the invention is primarily intended for a combination fuse which is to be used with capacitors in a capacitor bank. In such a capacitor bank, there may be a transient flow of energy initially into a failed capacitor. If the capacitor is not disconnected quickly, it will heat rapidly and burst. When a large fault current flows through the coil 28, it will start to arc along its length. Because of the increased thickness of wire at the head portion 31 and foot portion 30, which extends away from the respective end caps 17 and 25, the arcing is spaced from the end caps. This prevents arcs occurring between the end cap and the coil with a resulting puncture of the end cap. The arcing along the wire of coil 28 continues to build up, interacting with the surrounding arc quenching material, increasing the resistance of the path and limiting the current. It is believed the absence of a central support permits better contact within the arc quenching material and improves the current limiting capability. The fuse link 18 now begins to melt and/or vaporize creating an arc within expulsion tube 14. This arc interacts with coating 15, if one is provided, creating gases. The walls tend to cool the arc and this effect continues along the expulsion tube. The gases blow the cable 23 out of the expulsion tube, assisted by the spring force on the cable 23, and the circuit is interrupted. The expelled cable 23 is indicative of a blown fuse.

It is possible to make a current limiting fuse section according to the invention using a double coil of wire where the desired characteristics of the fuse require it. The fuse element is then wound on a mandrel using two similar conductors spaced apart to form two coils or helices. The ends are joined together at the head portion and the foot portion, preferably by doubling back an end of one coil upon itself to form with the end of the other coil a triple wire thickness and then forming the tip of the doubled back element around itself and the adjacent other coil end to secure it. The doubling back of both adjacent ends would, of course, form a portion of quadruple wire thickness or twice the cross-section of the double helix.

While I have illustrated preferred embodiments of my invention, many modifications will occur to those skilled in the art and I therefore wish to have it understood that I intend in the appended claims to cover all such modifications as fall within the true spirit and scope of my invention.

What I claim as new and desire to secure by Letters Patent of the United States is:

1. A method of making a high voltage, current limiting fuse section, comprising the steps of:

forming a helical coil of a resilient fuse element with a foot portion and a head portion at either end thereof, said head portion extending from said helical coil in a direction substantially parallel to the axis of said helical coil, mounting said foot portion to the inner side of a first end cap, securing said first end cap to one end of a cooperating, hollow, cylindrical, insulating casing, said coil being within said casing and spaced from the walls of said casing, engaging said head portion and withdrawing said head portion until it extends partly past the open end of said casing, filling said casing with pulverulent arc quenching material, securing a second end cap to the open end of said casing, part of said head portion projecting through a small opening in said second end cap, bending the projecting part of said head portion against the outer side of said second end cap and securing it thereto, and sealing said opening in said second end cap.

2. A method of making a high voltage, current limiting fuse section, comprising the steps of:

forming a helical coil of a resilient fuse element with a foot portion and a head portion of increased cross-section at either end thereof, forming said foot portion into a base part substantially parallel to a plane at right angles to the axis of said coil and an interim part extending at an angle thereto and curving to become the helix, forming said head portion to extend in a direction substantially parallel to said axis, conductively mounting said base part to the inner side of a first end cap, sealingly securing said first end cap to one end of a cooperating, hollow, cylindrical, insulating casing, said coil being within said casing and spaced from the walls of said casing, engaging said head portion and withdrawing it until the head portion extends partly past the open end of said casing and temporarily retaining it in that position, filling said casing with pulverulent arc quenching material, sealingly securing a second end cap to the open end of said casing, part of said head portion projecting through a small opening in said second end cap, bending the projecting part of said head portion against the outer side of said second end cap and conductively securing it to said second end cap, and sealing said opening in said second end cap.

3. A method of making a high voltage, current limiting fuse section for a combination fuse, comprising the steps of:

winding on a cylindrical mandrel a helical coil of a resilient wire fuse element having a length greater than four feet, removing the coil from the mandrel, providing a foot portion and a head portion of increased cross-section at either end of said coil, forming said foot portion into a base part substantially parallel to a plane at right angles to the axis of said coil and an interim part extending at an angle to said base part and curving to the helix, forming said head portion to extend from said coil in a direction substantially parallel to said axis, soldering said base part to the inner side of a first metallic end cap, securing and sealing said first end cap to the end of a cooperating hollow cylindrical casing of insulating material, said coil being within said casing spaced from the walls thereof and extending only part way towards the open end of said casing, engaging said head portion and withdrawing it until said head portion projects part way past the said open end of said casing and temporarily retaining it in that position, filling said casing by gravity flow of a pulverulent arc quenching material, releasing the head portion, securing and sealing a second metallic end cap to the open end of said casing, part of said head portion projecting through a small opening in said second end cap and part being within said casing, bending the projecting part of said head portion against the outer side of said second end cap, and soldering the bent projecting part of said head portion to said end cap and sealing said opening therein.

4. A method of making a fuse section as defined in claim 3 and further comprising, immediately after said step of filling said casing by gravity flow of a pulverulent arc quenching material, the step of vibrating said casing with assembled first end cap, coil and arc quenching material to consolidate said arc quenching material around said coil.

5. A method of making a fuse section as defined in claims 2, 3 or 4 in which the step of providing a foot portion of increased cross-section comprises bending the respective end of the coiled fuse element back upon itself to form a length of double thickness and then forming the element around itself at least for one turn to secure it.

6. A method of making a fuse section as defined in claims 2, 3, or 4 in which the step of providing a head portion of increased cross-section comprises bending the respective end of the coiled fuse element back upon itself to form a length of double thickness and then forming the element around itself at least for one turn to secure it.

7. A high voltage, current limiting fuse section comprising a tubular casing of insulating material, a first metallic end cap fastened to a first end of said casing closing said first end, a second metallic end cap fastened to a second end of said casing closing said second end, a free standing helical coil of a resilient fusible wire within said casing, and a pulverulent arc quenching material inside said casing filling said casing and contacting said coil, said coil having a foot portion at one end thereof and a head portion at the other end thereof, said foot portion being conductively connected with said first end cap, said head portion extending from the helix in a direction substantially parallel to the axis of said helical coil, through an opening in said second end cap filled with a material sealing said opening, and is conductively connected with said second end cap on the outer side thereof.

8. A high voltage, current limiting fuse section as defined in claim 7 in which said foot portion and head portion are of increased cross-section.

9. A high voltage, current limiting fuse section as defined in claim 8 in which said foot portion and head portion comprise a double length of wire formed by turning back a length of wire at the respective end, the tip of the turned back portion being wrapped around the wire for at least one turn.

10. A high voltage, current limiting fuse section as defined in claims 7, 8 or 9 in which said foot portion comprises a base part and an interim part, said base part being substantially parallel to a plane at right angles to said axis of said coil and said interim part extending from said base part at an angle and curving to form the helical coil.

11. A high voltage, current limiting fuse section as defined in claims 7, 8 or 9 in which said coil has a length in excess of four feet.

* * * * *